US008858107B2

(12) United States Patent
Urban

(10) Patent No.: US 8,858,107 B2
(45) Date of Patent: Oct. 14, 2014

(54) MEDIA PROCESSING DEVICE WITH ENHANCED MEDIA AND RIBBON LOADING AND UNLOADING FEATURES

(75) Inventor: Mark B. Urban, Mundelein, IL (US)

(73) Assignee: ZIH Corp., Lincolnshire, IL (US)

( * ) Notice: Subject to any disclaimer, the term of this patent is extended or adjusted under 35 U.S.C. 154(b) by 443 days.

(21) Appl. No.: 13/085,443

(22) Filed: Apr. 12, 2011

(65) Prior Publication Data

US 2011/0250000 A1 Oct. 13, 2011

Related U.S. Application Data

(60) Provisional application No. 61/323,270, filed on Apr. 12, 2010.

(51) Int. Cl.
*B41J 29/02* (2006.01)
*B41J 29/13* (2006.01)

(52) U.S. Cl.
CPC ..... *B41J 29/13* (2013.01)
USPC ..... 400/693; 400/691; 347/108; 347/152; 347/222; 347/263

(58) Field of Classification Search
USPC ..... 400/693
See application file for complete search history.

(56) References Cited

U.S. PATENT DOCUMENTS

| | | | | |
|---|---|---|---|---|
| 2,674,761 | A * | 4/1954 | Weiss | 16/288 |
| 5,207,521 | A * | 5/1993 | Ricca et al. | 400/693 |
| 5,268,705 | A * | 12/1993 | Dreinhoff et al. | 347/218 |
| 5,281,018 | A | 1/1994 | Cullinan | |
| 6,053,648 | A * | 4/2000 | Mistyurik | 400/693 |
| 6,095,704 | A * | 8/2000 | Jaeger et al. | 400/613 |
| 7,431,447 | B2 * | 10/2008 | Jensen | 347/108 |
| 2003/0081104 | A1 | 5/2003 | Dwyer et al. | |
| 2009/0115829 | A1 | 5/2009 | Reid | |
| 2009/0148223 | A1 * | 6/2009 | Fowler et al. | 400/693 |
| 2009/0315685 | A1 | 12/2009 | Bauchot | |

FOREIGN PATENT DOCUMENTS

| | | | |
|---|---|---|---|
| WO | WO 2005/031383 | A1 | 4/2005 |
| WO | WO 2007/106972 | A1 | 9/2007 |

OTHER PUBLICATIONS

Partial International Search Report for International Application No. PCT/US2011/032173, mailed Jun. 28, 2011.
Anonymous: "Zigbee", Wikipedia, the free encyclopedia, Jun. 5, 2010, XP002664610, Retrieved from the Internet: URL:http://en.wikipedia.org/w/index.php?title=ZigBee&oldid=366129285 [retrieved on May 1, 2012].
International Search Report and Written Opinion from International Application No. PCT/US2011/044243, mailed Mar. 20, 2012.

* cited by examiner

*Primary Examiner* — Jill Culler
(74) *Attorney, Agent, or Firm* — Alston & Bird LLP

(57) ABSTRACT

A device for processing media may include a front panel, a rear panel, a side panel, a support surface, and an access door assembly. The access door assembly may be pivotally coupled to the support surface and may include a major door pivotally coupled to a minor door. The minor door may be movable from an operational position to a minor support position and the major door may be movable from the operational position to a major support position in which the major door is positioned against and supported by the support surface. The side panel may define an imaginary plane that extends upward beyond the support surface and the access door assembly may be sized to be supported on the support surface without crossing the imaginary plane.

6 Claims, 13 Drawing Sheets

MEDIA PROCESSING DEVICE WITH ENHANCED MEDIA AND RIBBON LOADING AND UNLOADING FEATURES

CROSS-REFERENCE TO RELATED APPLICATIONS

This application claims the benefit of U.S. Provisional Application No. 61/323,270, filed Apr. 12, 2010, which is hereby incorporated herein in its entirety.

BACKGROUND OF THE INVENTION

Various embodiments of the invention are directed to printers and other systems for processing media including labels, receipt media, cards, and the like. Applicant has identified a number of deficiencies and problems associated with the manufacture, use, and maintenance of conventional printers. Through applied effort, ingenuity, and innovation, Applicant has solved many of these identified problems by developing a solution that is embodied by the present invention, which is described in detail below.

BRIEF SUMMARY

Various embodiments of the present invention are directed to a device and associated system for processing media using consumable components such as ink ribbon and rolled media. Example embodiments may provide a media processing device that may be structured to enhance user serviceability, simplify printhead alignment, and ease media routing, loading, and unloading. Such embodiments are configured to provide these advantages while maintaining a compact size footprint for the media processing device.

A device for processing media according to one embodiment of the present invention may include a front panel, a rear panel, a side panel, a support surface, and an access door assembly. The access door assembly may be pivotally coupled to the support surface and may include a major door pivotally coupled to a minor door. The minor door may be movable from an operational position to a minor support position and the major door may be movable from the operational position to a major support position in which the major door is positioned against and supported by the support surface. The side panel may define an imaginary plane that extends upward beyond the support surface and the access door assembly may be sized to be supported on the support surface without crossing the imaginary plane.

The housing may define an interior cavity that is accessible by a user when the major door is disposed in the major support position. The major door may include at least a portion of the front panel. The housing may define a support edge between the side panel and the support surface and the major door may be substantially coextensive with the support edge when the major door is disposed in the major support position. The minor door and at least a portion of the major door may be generally coplanar when the minor door and the major door are in the operational position. At least a portion of the major door may be substantially coplanar with the side panel when the major door is in the major support position.

Another device for processing media according to example embodiments of the present invention may include a platen assembly including a platen roller and a printhead assembly including a printhead that is pivotally movable from a loading position in which the printhead does not engage the platen roller to a printing position in which the printhead engages the platen roller. In the printing position, the printhead may or may not touch the platen roller depending on the presence of and dimensions of media substrate and/or ribbon positioned between the printhead and the platen roller. The device may further include a toggle assembly that is rotatable between an engaged position and a disengaged position, where the toggle assembly drives the printhead assembly from the loading position to the printing position in response to a user moving the toggle assembly from the disengaged position to the engaged position.

The toggle assembly may lift the printhead assembly from the printing position to the loading position in response to the toggle assembly moving from the engaged position to the disengaged position. The toggle assembly may include at least one driving element configured to drive the printhead assembly from the loading position to the printing position in response to the toggle assembly moving from the disengaged position to the engaged position. The at least one driving element may be adjustable and the toggle assembly may define a handle configured to be manually rotated by a user. The driving element may include pre-defined positions, each with indicia representing a different level of pressure. In the loading position, the printhead assembly may define a loading gap between the printhead and the platen roller.

The media processing device may further include a ribbon supply spindle and a ribbon take-up spindle, where a ribbon path is defined from the ribbon supply spindle, around the printhead assembly, to the ribbon take-up spindle. The ribbon path may be longer when the toggle assembly is in the engaged position than when the toggle assembly is in the disengaged position. The toggle assembly may be configured to rotate from the engaged position to the disengaged position in a counter-clockwise direction and the printhead assembly may be configured to move from the printing position to the loading position in a clockwise direction. The platen assembly may further include alignment forks configured to engage the printhead in response to the printhead assembly moving from the loading position to the printing position.

Another device for processing media according to example embodiments of the present invention may include a platen assembly including a platen roller and a printhead assembly including a printhead that is pivotally movable from a loading position in which the printhead does not engage the platen roller to a printing position in which the printhead engages the platen roller. The platen assembly may further include alignment forks configured to engage the printhead in response to the printhead assembly moving from the loading position to the printing position. The media processing device may further include a toggle assembly that is rotatable between an engaged position and a disengaged position, where the toggle assembly drives the printhead assembly from the loading position to the printing position in response to a user moving the toggle assembly from the disengaged position to the engaged position. The toggle assembly may lift the printhead assembly from the printing position to the loading position in response to the toggle assembly moving from the engaged position to the disengaged position. The toggle assembly may be configured to rotate from the engaged position to the disengaged position in a counter-clockwise direction and the printhead assembly may be configured to move from the printing position to the loading position in a clockwise direction.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Printers and media processing devices may be configured to print and/or encode media drawn from a roll or spool. Such media may include a web supporting a plurality of individually cut media components, such as adhesive-backed and carrier-supported labels, or the media may be a continuous web such as a spool of linerless label media or direct thermal tag stock. Printers process (e.g., print, encode, etc.) the media by drawing the media from the spool and routing the media proximate various processing components (e.g., printhead, RFID reader/encoder, magnetic stripe reader/encoder etc.). Processing the media from a spool may facilitate a continuous or batch printing process.

From time to time, printers exhaust the available supply of media such that a user must replace the media supply spool. Other consumables such as ribbon, printheads, and the like must also be periodically replaced. Once such consumables have been replaced, it is important that they be positioned/routed efficiently and precisely to ensure limited downtime and proper print quality.

Embodiments of the present invention are directed to an improved media processing device that is structured to enhance user serviceability, simplify printhead alignment, and ease media routing. Such embodiments are configured to provide these advantages while maintaining a compact size footprint.

Figure 1:
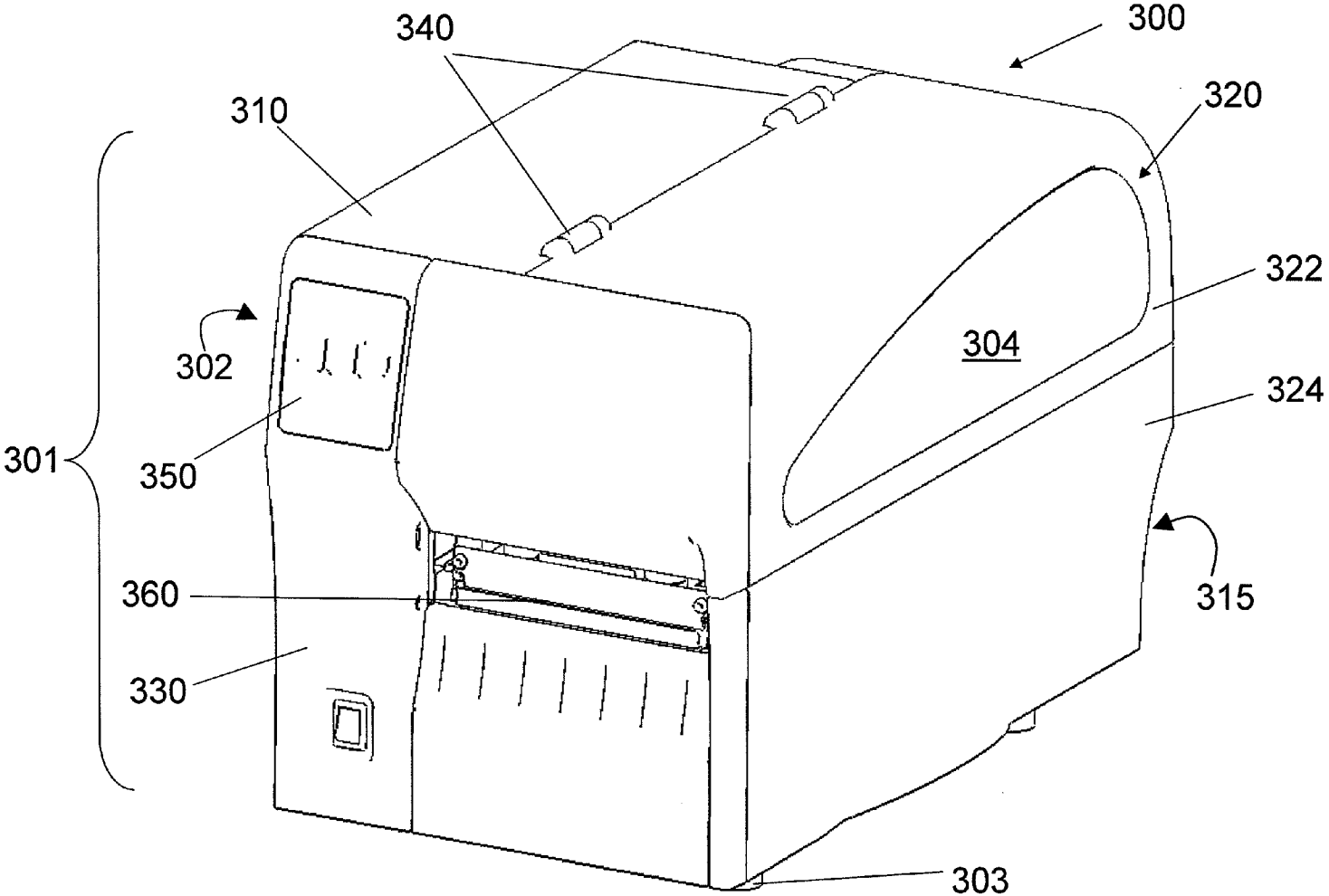
FIG. 1 illustrates a media processing device according to example embodiments of the present invention.

FIG. 1 illustrates a printer or processing device according to example embodiments of the present invention. While the illustrated embodiments and description provided herein are directed primarily to a printing device, other media processing devices such as media encoders or laminators, may benefit from the mechanisms described. Further, an example embodiment of the present invention may provide printing, encoding, and/or laminating functionality in a single device.

The printer 300 of FIG. 1 includes a housing 301 and a base 303. The housing 301 may include a front panel 330, a rear panel 315, a side panel 302, and a support surface 310. The housing may include a user interface 350 and a media exit 360. The media exit may be arranged in the front panel 330 of the printer 300 and may be configured to expel media after it has been processed. The housing may further include an access door assembly 320 comprising a major door 322 and a minor door 324. The major door 322 may be hingedly attached to the support surface 310 with hinges 340 and the minor door 324 may be hingedly attached to the major door 322. The access door assembly 320 of FIG. 1 is illustrated in the closed, operational position in which access to the internal components of the media processing device is precluded. In addition to keeping dirt, dust, and foreign objects from entering an internal cavity of the printer and potentially contaminating the consumables or the electronics of the processing device, the closed door may also reduce noise and prevent users from inadvertently touching sensitive components.

Figure 2:
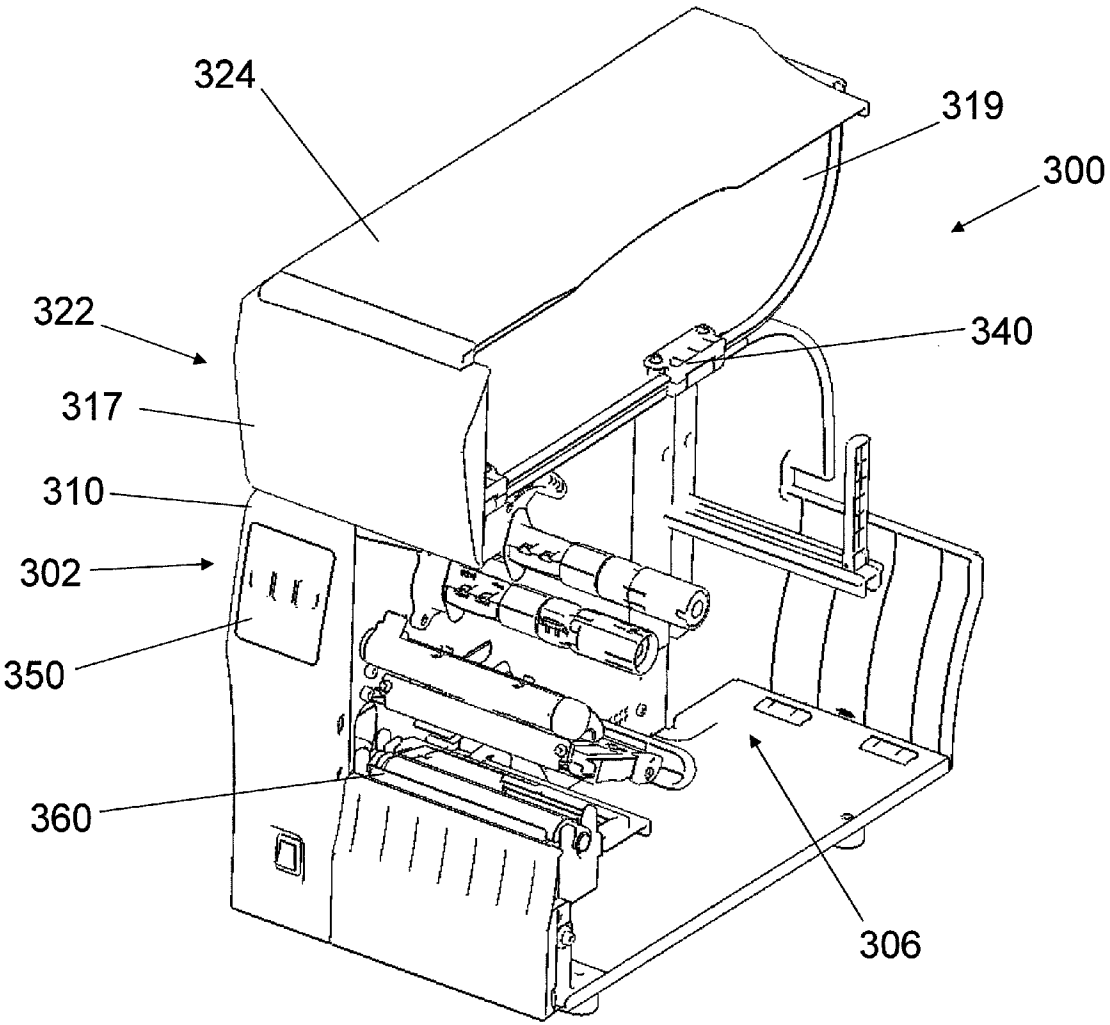
FIG. 2 illustrates a media processing device according to example embodiments of the present invention having an access door assembly disposed in a major support position.

The major door 322 of the access door assembly 320 may pivot about hinges 340 through a range of approximately 180 degrees to a major support position to provide access to an interior cavity 306 of the printer as illustrated in FIG. 2. The hinges 340 may be located proximate a centerline of the housing 301 defined between the support surface 310 and the access door assembly 320. Positioning the hinges 340 proximate a centerline of the housing 301 allows the access door assembly 320 to pivot about hinges 340 and achieve the major support position when the major door 322 comes to rest on the support surface 310. Locating the hinges 340 proximate the centerline of the housing 301 further enables the side panel 302 of the printer to be situated against a surface, such as a wall or a cabinet, while still permitting the access door assembly 320 to achieve the major support position. The major door 322 may include at least a portion of the front panel 317 and/or a portion of the rear panel 319 to provide greater access to the interior cavity 306 when the major door is disposed in the major support position as will be described further below. In other embodiments, however, the major door 322 may include only a portion of the front panel.

The minor door 324 may be hingedly attached to the major door 322 and pivotable between an operational position (as shown in FIG. 1) and a minor support position (as shown in FIG. 2). In the operational position, the minor door 324 may be substantially co-planar with the access door assembly side 304 of the housing. In this operational position, the media processing device is ready for use and the internal cavity 306 is not accessible due to the position of the access door assembly 320. Optionally, operation of the media processing device may be precluded when the access door assembly 320 is not in the operational position. As the major door 322 is rotated about hinges 340, through a range of approximately 180 degrees, the minor door 324 pivots about hinges 323 through a range of approximately 90 degrees relative to the major door 322.

Figure 4:
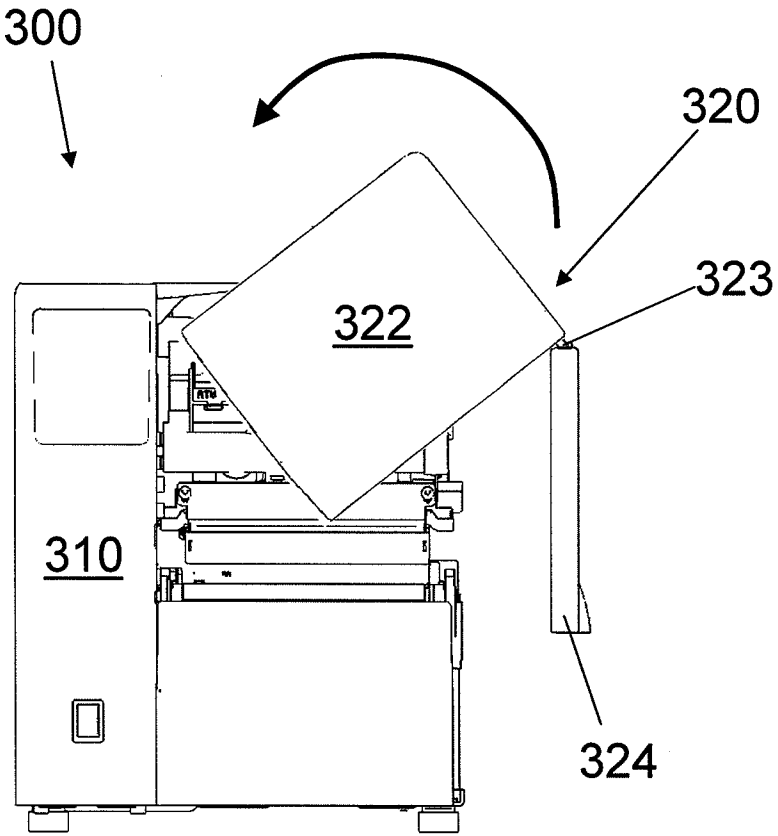
FIG. 4 depicts a front view of the media processing device shown in FIG. 2, wherein the access door assembly is disposed in transition between the operational position and the full support position.
Figure 3:
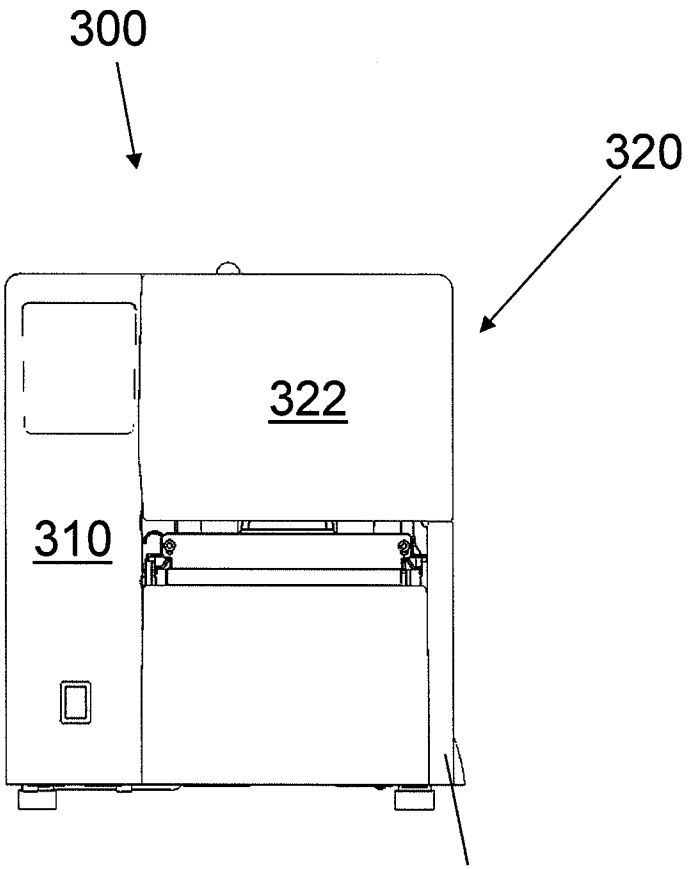
FIG. 3 depicts a front view of the media processing device shown in FIG. 2, wherein the access door assembly is disposed in an operational position.
Figure 5:
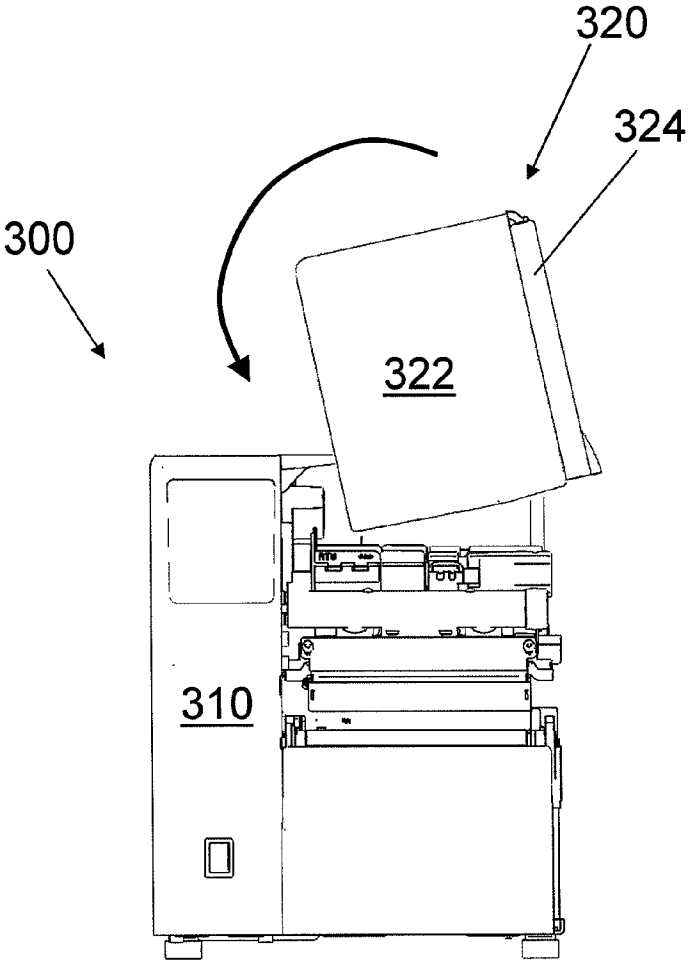
FIG. 5 depicts a front view of the media processing device shown in FIG. 2, wherein the access door assembly is comprised of a major door and a minor door, and wherein the minor door is disposed in a minor support position.

FIGS. 3-6 illustrate a frontal view of a media processing device according to example embodiments of the present invention. FIG. 3 illustrates the access door assembly 320 in an operational position where the minor door and at least a portion of the major door are generally coplanar. FIG. 4 illustrates the access door assembly 320 in transition between the operational position and the major support position. FIG. 5 illustrates the minor door 324 in the minor support position and the access door assembly 320 in transition between the operational position and the major support position. In the operational position, the back surface of the minor door faces the internal cavity 306 of the media processing device 300. When disposed in the minor support position, the back surface of the minor door 324 rests against at least a portion of the major door 322. In the illustrated embodiment, the major door includes a portion of the front surface 317 and the rear surface 319 (see FIG. 2) upon which the minor door 322 rests in the minor support position. Optionally, should the major door 322 not include portions of the front surface 317 and rear surface 319, the minor door may rest upon a stop or be supported by a maximum permitted rotation by the hinges 323 when in the minor support position.

Figure 6:
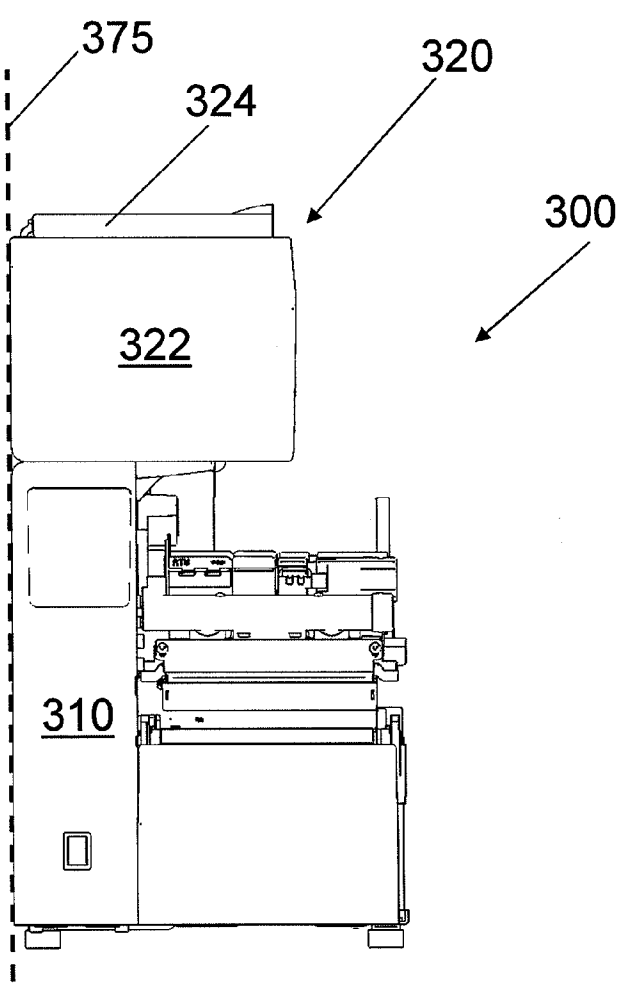
FIG. 6 depicts a front view of the media processing device shown in FIG. 2, wherein the major door is disposed in a major support position, the minor door is disposed in the minor support position, and the access door assembly is disposed in the full support position.

FIG. 6 illustrates the access door assembly 320 in the major support position and the minor door 324 in the minor support position. A portion of the major door 322 may be supported by the support surface 310 of the media processing device when the major door 322 is rotated about hinges 340 about 180 degrees. This position is called the major support position. Further illustrated in FIG. 6 is an imaginary plane 375 extending upwardly beyond the support surface 310. The access door assembly 320 may be supported on the support surface without crossing the imaginary plane 375, thereby allowing the side panel 302 of the printer 300 to be situated against a surface without hindering the opening of the access door assembly 320. A portion of the major door may be substantially coplanar with the side panel when the major door is in the major support position illustrated in FIG. 6.

Referring back to FIG. 2, when the major door 322 is in the major support position, access to all of the necessary components to load and unload consumables (e.g., print media and printer ribbon) within internal cavity 306 is provided. Access to the internal cavity 306 is provided, at least partially, through at least three sides (e.g., the front side via a portion of the front panel 317, the access door side and top side through the access door assembly 320, and/or the rear side via a portion of the rear panel 319) which permit easier access and view of the internal components as will be described below. In other embodiments, the major door 322 may include only one, or possibly neither of a portion of the front panel 317 or the rear panel 319.

Figure 7:
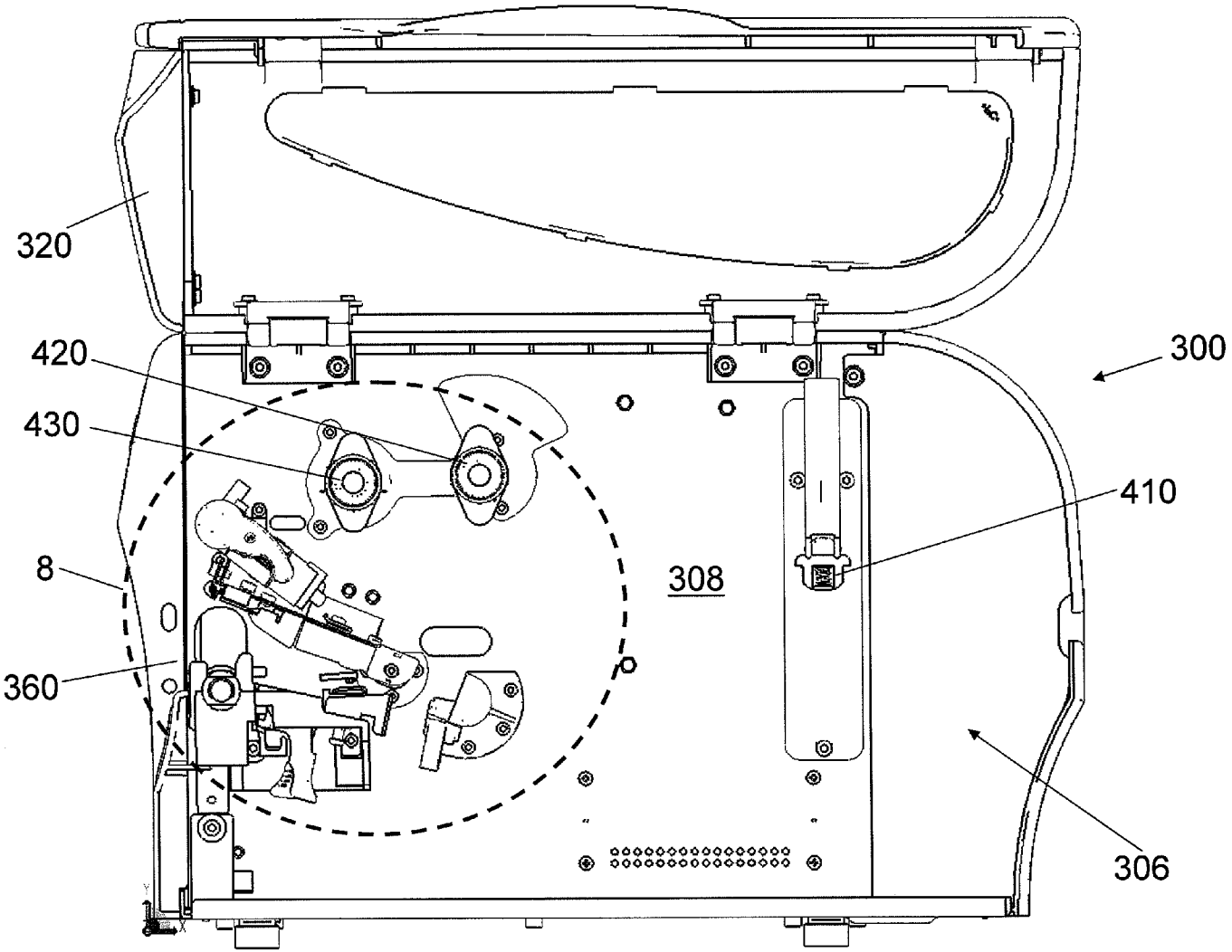
FIG. 7 illustrates a side view of a media processing device according to example embodiments of the present invention wherein the access door assembly is disposed in the full support position.

FIG. 7 illustrates a side view of a printer according to example embodiments of the present invention with the major door 322 of the access door assembly 320 in the major support position exposing the internal cavity 306 and the printer chassis 308. The printer chassis 308 is a structural member configured to support some or all of the internal components of the printer 300. The internal components within the internal cavity 306 may include a media spindle 410, a ribbon supply spindle 420, and a ribbon take up spindle 430. The media spindle 410 may be configured to hold a media spool (not shown) or media roll. The ribbon supply spindle 420 may be configured to hold a spool of the unused portion of a ribbon while the ribbon take-up spindle 430 may be configured to hold a spool of the used portion of the ribbon. Also illustrated is the media exit 360 through which printed media exits the printer 300. The printer chassis 308 holds the media spindle 410, ribbon supply and take-up spindles 420, 430, and the printing mechanisms in place within the internal cavity 306.

Figure 8:
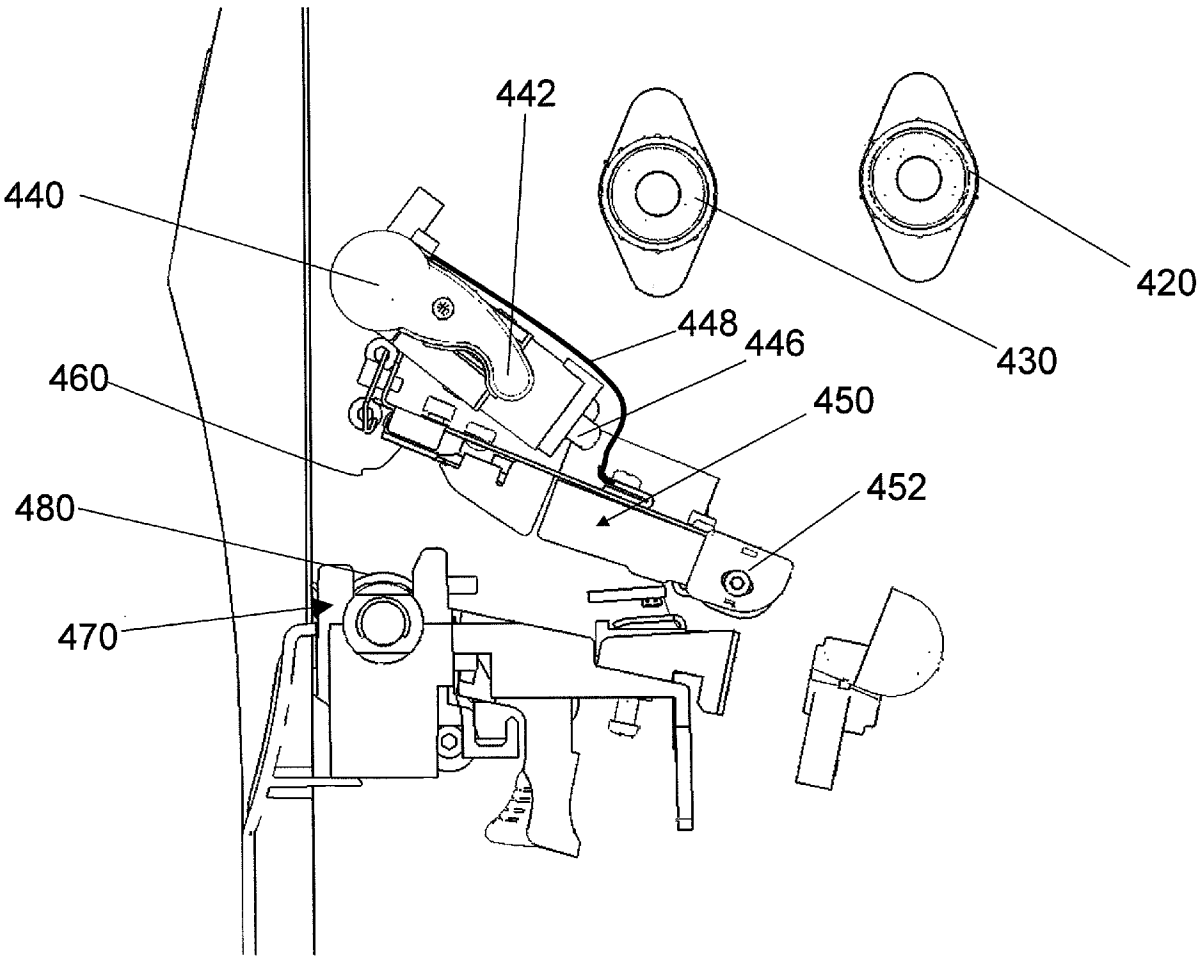
FIG. 8 illustrates a detail view of a printing mechanism of a media processing device, taken along detail circle 8 of FIG. 7.
Figure 9:
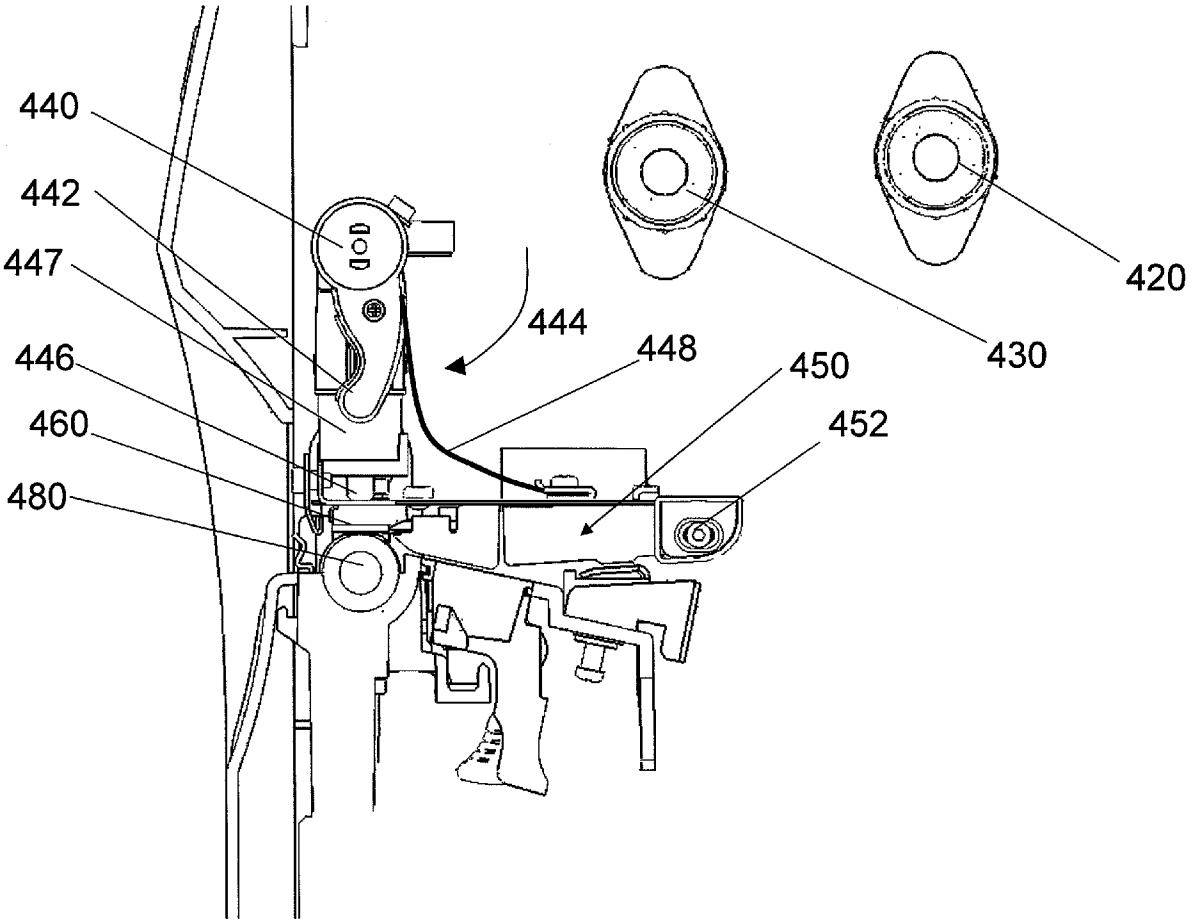
FIG. 9 illustrates a detail view of the printing mechanism of FIG. 8, wherein the printing mechanism is disposed in a printing position.

The printer chassis 308 may further hold a printing mechanism as shown in detail circle 8 which is further illustrated in FIGS. 8 and 9 depicting an enlarged view of the detail circle 8 of FIG. 7. The printing mechanism may include a printhead assembly 450 including a printhead 460, a platen assembly 470 including a platen roller 480, and a toggle assembly 440 including a toggle handle 442, a driving member 446, and a lift strap 448.

The printhead assembly 450 is illustrated in a loading position in FIG. 8 and a printing position in FIG. 9. The illustrated printing mechanism embodiment may be configured for thermal transfer printing wherein the printhead 460 and the platen roller 480, when engaged, define a nip therebetween. A media substrate and a printer ribbon may be fed through the nip and the printhead may heat and compress the ribbon against the media substrate to deposit ink from the ribbon onto the media substrate. In the printing position, the printhead 460 engages platen roller 480 along a print line.

In the illustrated embodiment, the printhead assembly 450 of the printing mechanism is pivotally attached along axis 452 to the printer chassis 308. The printhead assembly 450 includes the printhead 460 which is mounted to the printhead assembly with a retention spring mechanism as will be further detailed below. The toggle assembly 440 is pivotally attached to the printer chassis 308 and is configured to be manually rotated by a user via handle 442 between a disengaged position (FIG. 8) and an engaged position (FIG. 9). As the toggle assembly 440 is rotated from the disengaged position to the engaged position along arrow 444, the driving elements 446 drive the printhead assembly 450 into the printing position. The driving elements 446 may include a curved profile configured to slidably engage a surface of the printhead assembly 450 as the toggle assembly 440 is rotated along arrow 444. The curved profile of the driving elements may provide a cam-type functionality which moves along the printhead assembly 450 as the toggle assembly 440 is rotated and drives the printhead assembly 450 into the printing position. Thus, the contact areas between the driving elements 446 and the printhead assembly 450 may be configured to allow a sliding motion as the toggle assembly is rotated to the engaged position. Detents within the toggle assembly 440 are configured to retain the toggle assembly in either the engaged position or the disengaged position. When the toggle assembly 440 is in the engaged position, the driving elements 446 hold the printhead assembly 450 in the printing position with the printhead 460 engaged with the platen roller 480. In response to the toggle assembly being moved from the engaged position of FIG. 9 to the disengaged position of FIG. 8, the driving elements 446 are disengaged from the printhead assembly 450 and the lift strap 448 is configured to raise the printhead assembly 450 out of the printing position and into the loading position.

The driving elements 446 may be adjusted such that the amount of pressure applied to the printhead assembly 450 in the engaged position is variable. The adjustment mechanism may be arranged within adjustment members 447 wherein the adjustment members 447 are configured to be moved between pre-defined positions. The movement may be achieved by rotating an end of the adjustment member 447 which either extends or retracts the driving element 446 dependent upon the direction of rotation. The adjustment members may be configured with indicators of the pre-defined positions to which the adjustment mechanism may be moved. The pre-defined positions may be indicated by figures, numbers, or other indicia that allows a user to easily interpret the effect of the adjustment (e.g., more pressure or less pressure). Further, embodiments which include multiple driving elements 446 may include an adjustment member 447 for each driving element 446. The pre-defined positions with marked indicia may be used to adjust the driving elements 446 to the same, or possibly different positions, resulting in different levels of pressure applied across the printhead assembly 450 by the driving elements 446. Adjusting the driving elements 446 to a longer length results in greater pressure applied to the printhead assembly 450, thereby increasing the pressure of the printhead 460 against the platen roller 480. The adjustable driving elements 446 enable a user to adjust the printhead pressure to optimize the print quality.

The lift strap 448 may be attached at one end to the toggle assembly 440 and at the other end to the printhead assembly 450. The lift strap 448 may be made of any flexible, high-tensile strength material with low elasticity, but is preferably a polyester film. In response to the toggle assembly 440 being moved from the engaged position of FIG. 9 to the disengaged position of FIG. 8, the toggle assembly 440 lifts the lift strap 448 to raise the printhead assembly 450 from the printing position to the loading position. Further, the lift strap 448 suspends the printhead assembly 450 in the loading position while the toggle assembly 440 is in the disengaged position.

Figure 10:
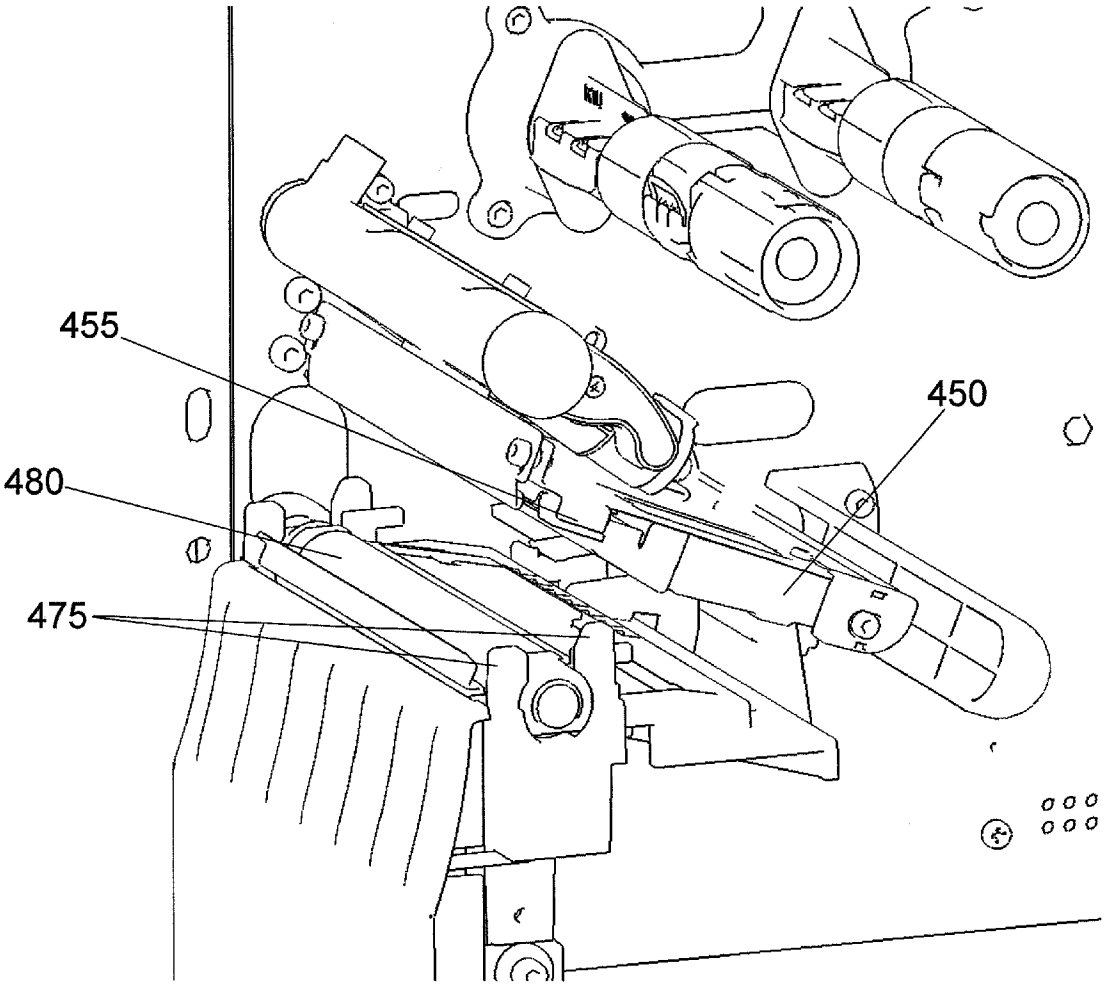
FIG. 10 illustrates a perspective detail view of the printing mechanism of FIG. 8, wherein the printing mechanism is disposed in the loading position.
Figure 11:
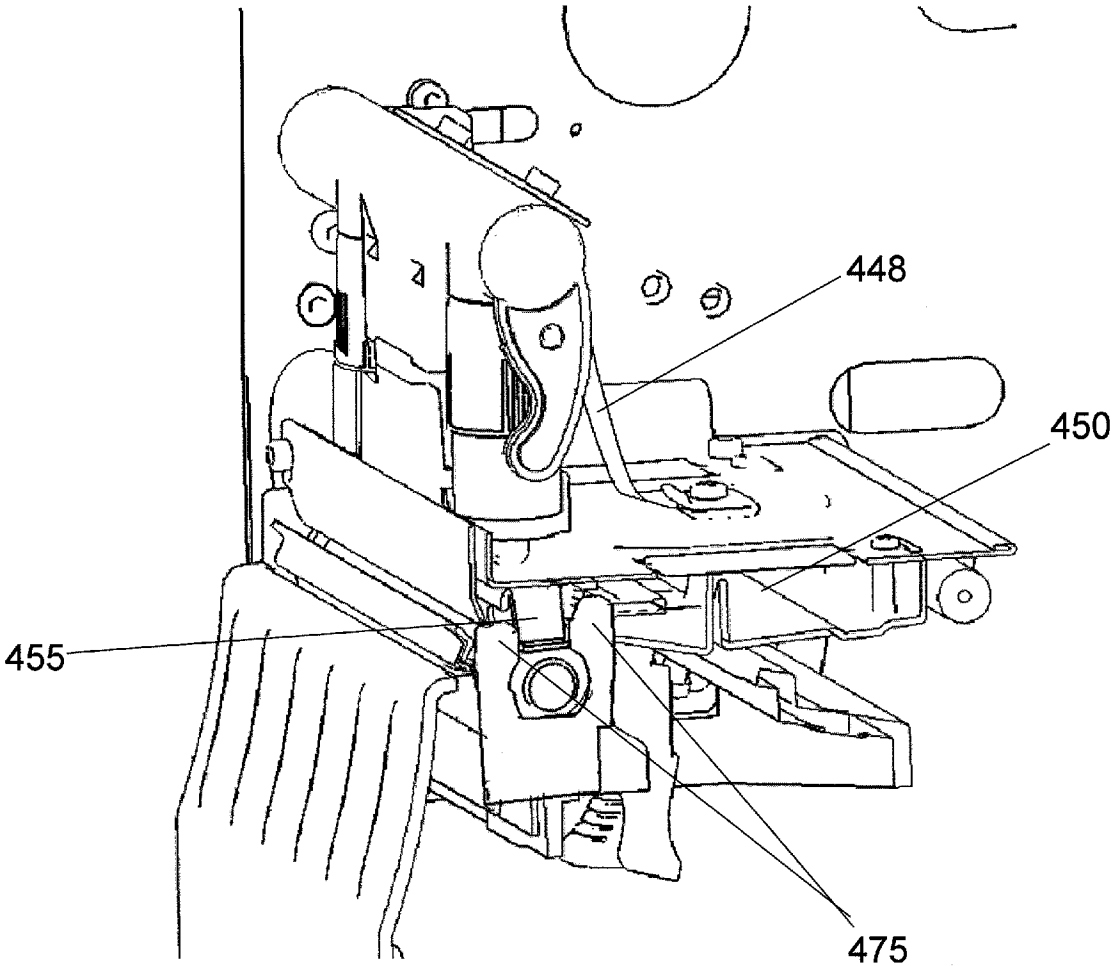
FIG. 11 illustrates a perspective detail view of the printing mechanism of FIG. 8, wherein the printing mechanism is disposed in the printing position.

FIGS. 10 and 11 illustrate perspective views of the print mechanism in the loading position and the printing position respectively. As illustrated, in the loading position of FIG. 10, the printhead assembly 450 is raised away from the platen roller 480 and platen assembly. The platen assembly includes forks 475 projecting upwardly from the platen assembly and configured to engage the printhead assembly 450. The forks 475 are configured with a bevel disposed on their inward-facing sides arranged to receive a corresponding tab 455 from the printhead assembly 450. The tab 455 engages the forks 475 to align the printhead 460 with the platen roller 480. The forks 475 align the printhead 460 to the platen roller 480 to achieve the optimum print-line location between the components. Proper alignment results in higher quality printing. As the printhead assembly 450 is moved from the loading position to the printing position, the forks 475 engage the tabs 455 of the printhead 460 to adjust the location of the printhead 460 relative to the platen roller 480 to achieve proper alignment.

Figure 12A:
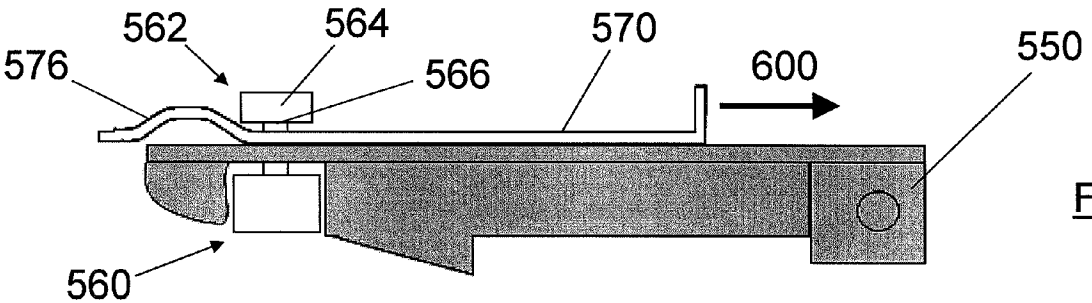
FIG. 12A is a side view of a printhead assembly for a media processing device according to example embodiments of the present invention with a retention spring in a disengaged position.
Figure 12B:
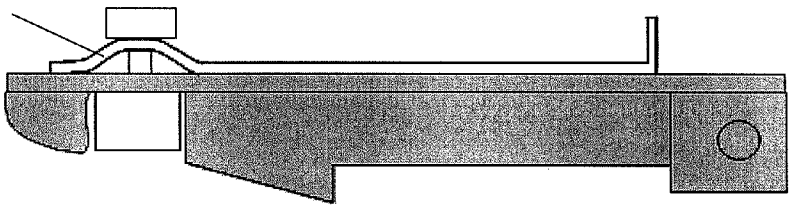
FIG. 12B is a side view of the printhead assembly of FIG. 12A, wherein the retention spring in an engaged position.
Figure 12C:
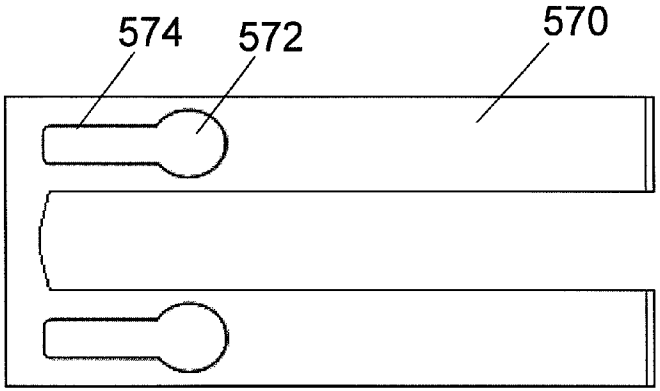
FIG. 12C is a top view of a retention spring structured according to example embodiments of the present invention.

Example embodiments of the present invention may provide a quick-release printhead attachment mechanism whereby the printhead 560 is secured to the printhead assembly 550. FIG. 12A depicts a printhead assembly 550 including a printhead 560. The printhead 560 may include one or more studs 562 extending from the back of the printhead 560. The studs 562 include a relatively large diameter head 564 with a relatively small diameter stem 566. The printhead 560 is configured to be securely attached to the printhead assembly 550 by inserting the studs 562 through a respective through hole in the printhead assembly 550 and through a respective keyhole 572 in a retention spring 570 when the retention spring is in the unlocked position depicted in FIG. 12A. An example embodiment of the top view of a retention spring is illustrated in FIG. 12C including the keyhole 572 with a keyway 574. Once the studs 562 of the printhead 560 are inserted through the printhead assembly 550 and the keyhole 572 of the retention spring 570, the retention spring 570 may be slid in the direction of arrow 600 to a locked position as illustrated in FIG. 12B.

In response to the retention spring 570 being slid in the direction of arrow 600, the stud 562 slides from keyhole 572 to keyway 574. The head 564 of the stud 562 is configured to be a greater diameter than the width of the keyway 574 such that the stud cannot be removed from the printhead assembly 550 as the stud head 564 will not pass through the keyway 574 of the retention spring 570. As the retention spring 570 is moved in the direction of arrow 600, the head 564 of the stud 562 is engaged by an arcuate portion 576 of the retention spring 570. The arcuate portion 576 drives the head 564 of the stud 562 in an upward direction relative to the printhead assembly 550, thereby drawing the printhead 560 into a secured position on the printhead assembly 550. The retention spring 570 maintains the printhead 560 in the secured position as the arcuate portion 576 in its relaxed state is of greater height than the height of the stud head 564 in the secured position. The resultant deformation of the arcuate portion 576 maintains tension on the stud 562, thereby holding the printhead 560 securely in position on the printhead assembly 550.

Removal of the printhead 560 from the printhead assembly 550 may be performed by sliding the retention spring 570 in a direction opposite arrow 600, disengaging the arcuate portion 576 from the stud 562 and allowing the stud head 564 to pass through the keyhole 572 and the through-hole through the printhead assembly 550.

Figure 13:
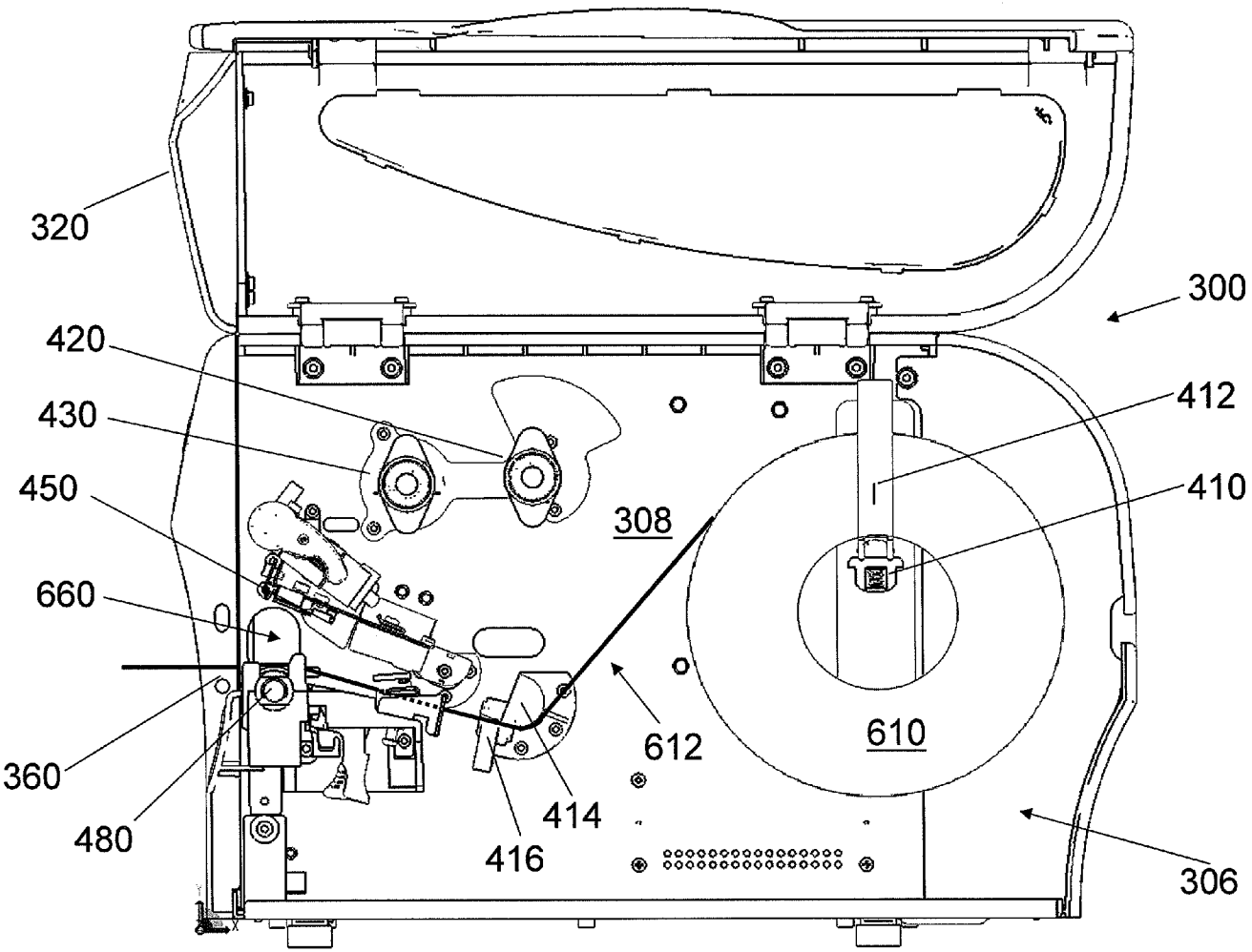
FIG. 13 is a side view of the media processing device of FIG. 7 with a roll of media installed.

Before a printing operation may begin, the print media must be loaded into the printer. FIG. 13 illustrates the printer of FIG. 7 with a media roll 610 loaded on the media spindle 410. The illustrated embodiment includes a media spindle alignment feature 412, a media guide 414, and a media sensor 416. The alignment feature 412 that may fold or rotate to a loading position, whereby a media roll 610 may be loaded onto the media spindle 410, and subsequently, the alignment feature 412 may fold or rotate back into engagement with the media roll 610 to maintain the media roll 610 in the proper position on the media spindle 410. The media web 612 may extend from the media roll, through one or more guiding features, to the printing mechanism and/or other processing components. In the illustrated embodiment, the media web 612 extends from the media roll 610, around the media guide 414 and past the media sensor 416 to arrive at the printhead assembly 450.

The media sensor 416 may provide a signal to the printer electronics when the media web is present which may allow the printer to determine when printing may occur. The media sensor may be configured to read or otherwise sense the transition or delineation between individual media elements on the media web 612 to enable alignment of the image printed at the print line of the printhead 460 relative to the edges of the media element. The media web 612 may extend along the printhead assembly 450, between the nip defined by the printhead 460 and the platen roller 480, and out through the media exit 360. As illustrated, when the printhead assembly 450 is disengaged from the platen roller 480, a loading gap 660 is created between the printhead 460 and the platen roller 480 which allows a user to more easily feed the media web 612 from the media roll 610, past the media sensor 416, and through the print mechanism to the media exit 360. Conventionally, if the printhead 460 does not disengage from the platen roller 480, the structure of the platen/printhead nip can present a conflict in that tight tolerances between the printhead 460 and the platen 480 assist in printing, but such tolerances may make it difficult for a user to insert the print media web 612 between the printhead 460 and the platen 480 during loading of the print media web 612 into the printer 300.

Figure 14:
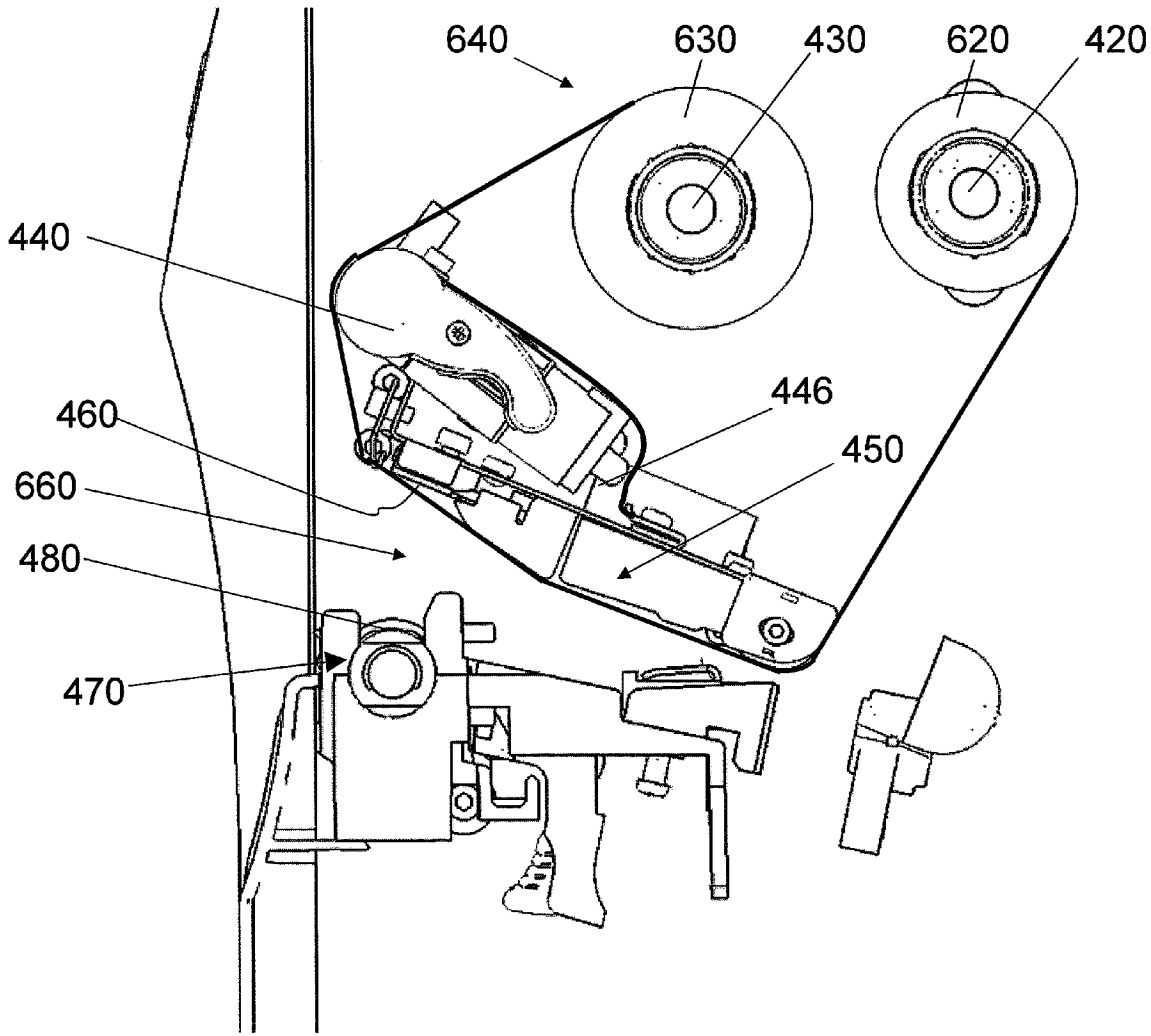
FIG. 14 is a detail view of the printing mechanism of FIG. 8, wherein the printing mechanism is disposed in the loading position and ribbon has been installed.

Example embodiments of the present invention may allow simplified media loading as described above; however, example embodiments may further provide for simplified ribbon loading as described herein. Thermal transfer printers use an ink ribbon that contains ink disposed on a substrate, where the ink is transferred to a media substrate via pressure and heat. Media processing devices according to example embodiments of the present invention may use any number of types of ribbons including dye ribbons, hologram ribbons, security material ribbons, and UV coating ribbons, among others. Therefore, in addition to the media substrate being loaded and aligned between the printhead assembly 450 and the platen roller 480, the ink ribbon 640 must be similarly inserted between the printhead 460 and the platen roller 480. FIG. 14 illustrates the printing mechanism of FIG. 8 with a printer ribbon installed. The ink ribbon 640 includes a supply spool 620 and a take-up spool 630, each disposed on a respective spindle. The ink ribbon 640 is fed along an ink ribbon path extending from the supply spool 620, around the printhead assembly 450, past the printhead 460. The ink ribbon 640 makes a relatively sharp upward transition after the printhead 460 toward the toggle assembly 440, around which the ink ribbon bends to arrive at the take-up spool 630. The relatively sharp transition after the printhead 460 provides a peel-mechanism whereby the ink ribbon is lifted from the media substrate at a sharp angle to reduce the flash or excess ink that may surround a printed image.

Figure 15:
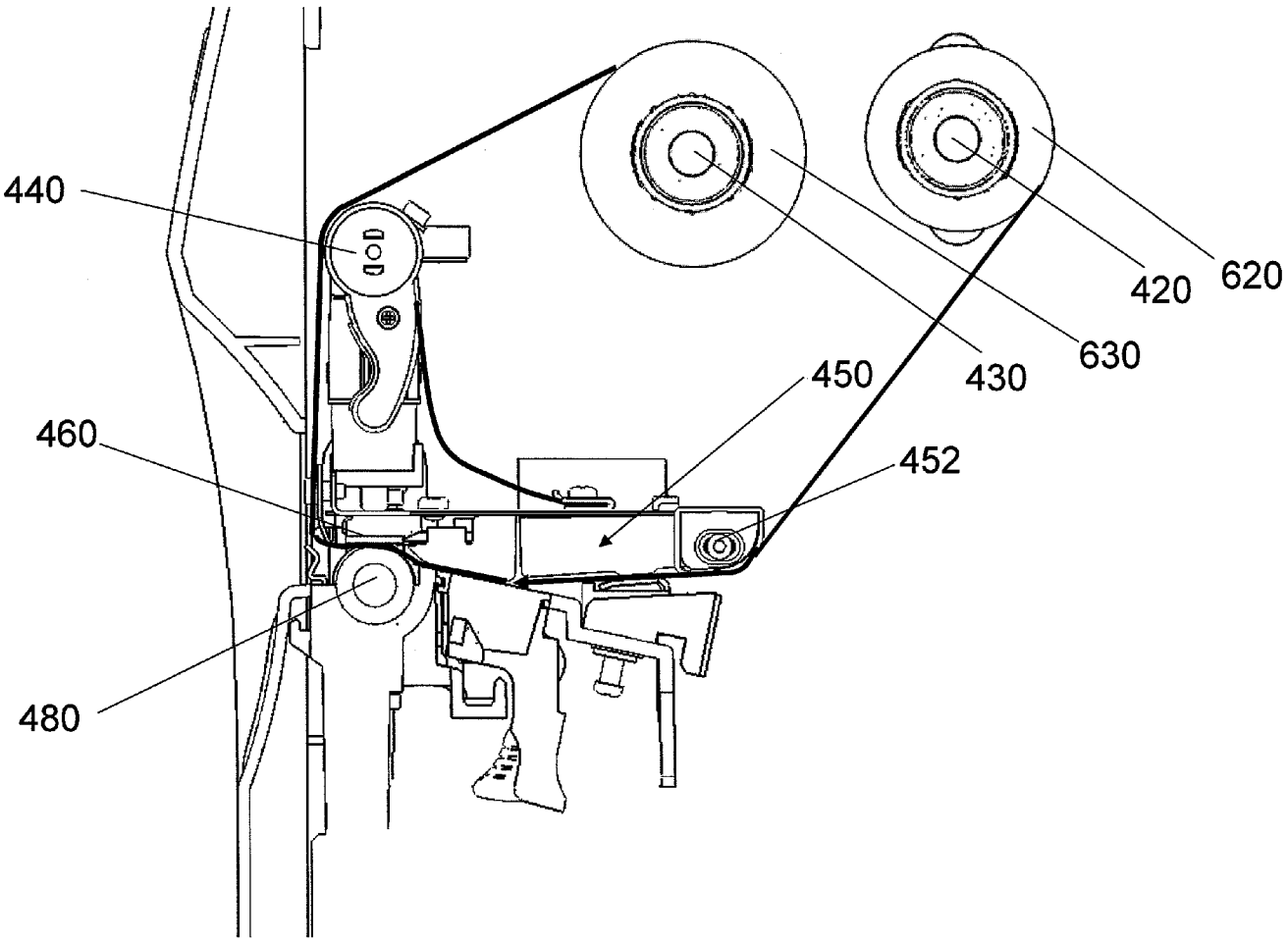
FIG. 15 is a detail view of the printing mechanism of FIG. 14, wherein the printing mechanism is disposed in the printing position.

FIG. 14 illustrates the ink ribbon 640 installed onto the print mechanism and properly routed past the printhead 460. As illustrated, the loading gap created 660 when the printhead assembly 450 is disengaged from the platen roller 480 allows the ribbon 640 to be easily routed and aligned to the printhead assembly 450. FIG. 15 illustrates the ink ribbon 640 as installed with the printhead assembly 450 in the engaged position. As depicted, the path from the supply spool 620 to the take up spool 630 is longer when the printhead assembly 450 is in the printing position such that when the toggle assembly 440 is moved from the loading position to the printing position, tension is applied to the ink ribbon 640. The tension applied to the ink ribbon 640 is desirable and ensures that the ink ribbon 640 lays flat against the printhead 460. Further, the tension applied to the ink ribbon 640 provides more consistent and repeatable alignment of the ribbon.

As will be apparent to one of ordinary skill in the art in view of this disclosure, print media and ink ribbon may be loaded and fed with greater ease and flexibility by incorporating one or more structures herein discussed.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A media processing device, comprising:

a base;

a housing supported by the base, the housing comprising:

a front panel, a rear panel, a side panel, a support surface, and an access door assembly pivotally coupled to the support surface, the access door assembly comprising a major door pivotally coupled to a minor door, wherein the major door comprises a portion of the front panel, wherein the portion of the front panel extends across more than half of a width of the front panel, wherein the minor door is moveable from an operational position to a minor support position, wherein the major door is movable from the operational position to a major support position in which the major door is positioned against and supported by the support surface, wherein the side panel defines an imaginary plane extending upwardly beyond the support surface, and wherein the access door assembly is sized to be supported on the support surface without crossing the imaginary plane.

2. The media processing device of claim 1, wherein the housing defines an interior cavity, and wherein the interior cavity is accessible by a user when the major door is disposed in the major support position.

3. The media processing device of claim 1, wherein the major door comprises at least a portion of the front panel.

4. The media processing device of claim 1, wherein the housing defines a support edge between the side panel and the support surface, and wherein the major door is substantially coextensive with the support edge when disposed in the major support position.

5. The media processing device of claim 1, wherein the minor door and at least a portion of the major door are generally coplanar when the minor door and the major door are in the operational position.

6. The media processing device of claim 1, wherein at least a portion of the major door is substantially coplanar with the side panel when the major door is in the major support position.

* * * * *

UNITED STATES PATENT AND TRADEMARK OFFICE

CERTIFICATE OF CORRECTION

PATENT NO. : 8,858,107 B2
APPLICATION NO. : 13/085443
DATED : October 14, 2014
INVENTOR(S) : Urban It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 504 days.

Signed and Sealed this
Fifteenth Day of September, 2015

Michelle K. Lee

Michelle K. Lee
*Director of the United States Patent and Trademark Office*